US005263883A

United States Patent [19]

Kirayoglu

[11] Patent Number: 5,263,883

[45] Date of Patent: Nov. 23, 1993

[54] MINIATURE DISCONNECT TERMINAL

[75] Inventor: Erol M. Kirayoglu, Tryon, N.C.

[73] Assignee: Specialty Electronics, Inc., Landrum, S.C.

[21] Appl. No.: 955,848

[22] Filed: Oct. 2, 1992

[51] Int. Cl.[5] ..... H01R 13/00

[52] U.S. Cl. ..... 439/856

[58] Field of Search ..... 439/842, 851, 852, 853, 439/856, 857, 861, 862

[56] References Cited

U.S. PATENT DOCUMENTS 3,915,537 10/1975 Harris et al. ..... 339/64

4,480,386 11/1984 Adams ..... 29/874

4,498,725 2/1985 Bright et al. ..... 339/176

5,049,095 9/1991 Gugelmeyer ..... 439/856

*Primary Examiner*—Joseph H. McGlynn

*Attorney, Agent, or Firm*—Thomas Hooker

[57] ABSTRACT

A miniature disconnect terminal stamp-formed from thin sheet metal stock includes a mounting plate, a bridge, terminal tails extending to either side of the plate and bridge and a pair of hook-shaped spring members extending to one side of the bridge. The spring members include series-oriented cantilever and torsion springs and rigid contact arms at the free ends of the members.

38 Claims, 4 Drawing Sheets

MINIATURE DISCONNECT TERMINAL

FIELD OF THE INVENTION

The invention relates to stamp-formed miniature electrical disconnect terminals of the type commonly used for forming electrical connections with contact pins inserted into the terminals.

DESCRIPTION OF THE PRIOR ART

Conventional stamp-formed terminals designed to mate with inserted pins use single or dual cantilever contact arms with contact surfaces on the free ends of the arms. A pin inserted into a conventional terminal bends each arm along its length thereby deforming the arm as a cantilever beam and generating a contact force resiliently urging the contact surface against the side of the inserted pin. The cantilever springs extend along the length of the terminals and, of necessity, are limited in length by the height of the terminals themselves.

Conventional connector block design provides sufficient space adjacent the terminal, both extending along the height of the terminal and space extending laterally from the terminal, to accommodate relatively large disconnect terminals in which the thickness and length of the cantilever beams are sufficient to provide a sufficient deflection range and contact force to establish and maintain a reliable electrical connection with an inserted pin.

Miniaturization of circuit elements, particularly integrated circuit chips and the like which are mounted on supporting substrates, has required miniaturization of supporting circuit elements, including the connector blocks and terminals mounted on substrates for forming electrical connections with inserted pins. Miniaturization of connector blocks required by miniaturization of circuit elements reduces the height available for disconnect terminals and requires that the terminals be stamp-formed from very thin metal stock. Reduction in size of the terminal does not, however, reduce the production tolerances inherent in the stamping operations. With reduction in size of the terminals, these inherent tolerances, together with wear of the tooling used to form the terminals, make it very difficult to assure terminals are manufactured to design specification with the spring arms located in proper position to engage the inserted pin and with a proper range of deflection. As a result, miniaturized terminals manufactured with a cantilever arm contacts have extremely high contact pressure and reduced deflection range and are not reliable.

SUMMARY OF THE INVENTION

The invention is a stamp-formed miniature disconnect terminal formed from sheet metal stock with sufficient contact pressure and a wide deflection range, thereby assuring formation of reliable electrical connections with inserted pins. The terminal has a height equal to or less than the present height of integrated circuit chips and may be used in housings mounted on a circuit board for reception of pins extending from a pin header without extending above other components on the board. The housings do not extend above the chips.

The terminal includes a mounting plate for securing the terminal in place within a terminal cavity in a housing and a bridge joining the plate. A terminal tail extends outwardly from the plate or bridge for forming electrical connection with a pad on a board. A pair of hook-shaped spring members extend away from the bridge and each include a pair of spring arms and a rigid arm arranged in a series with the fixed arm located at the end of the member. A first tapered cantilever and torsion arm extends away from the bridge. A second tapered cantilever and torsion arm extends perpendicularly away from the outer end of the first arm and along the mounting plate, at a distance away from the plate. The rigid contact arm extends perpendicularly away from the outer end of the second arm and back toward the plate. The hook-shaped spring members provide a total spring length greater than the height of the terminal, thereby providing a lower spring rate and increasing the deflection range for the arms. In this way, the miniaturized disconnect terminals afford reliable electrical connections with inserted pins despite manufacturing tolerances.

The rigid contact arms are bent inwardly toward each other. Insertion of a pin into a terminal both spreads the arms apart and rotates the arms so that each spring arm is deformed as a cantilever spring and as a torsion spring.

Other objects and features of the invention will become apparent as the description proceeds, especially when taken in conjunction with the accompanying drawings illustrating the invention, of which there are four sheets and two embodiments.

DESCRIPTION OF THE PREFERRED EMBODIMENT

Figure 1:
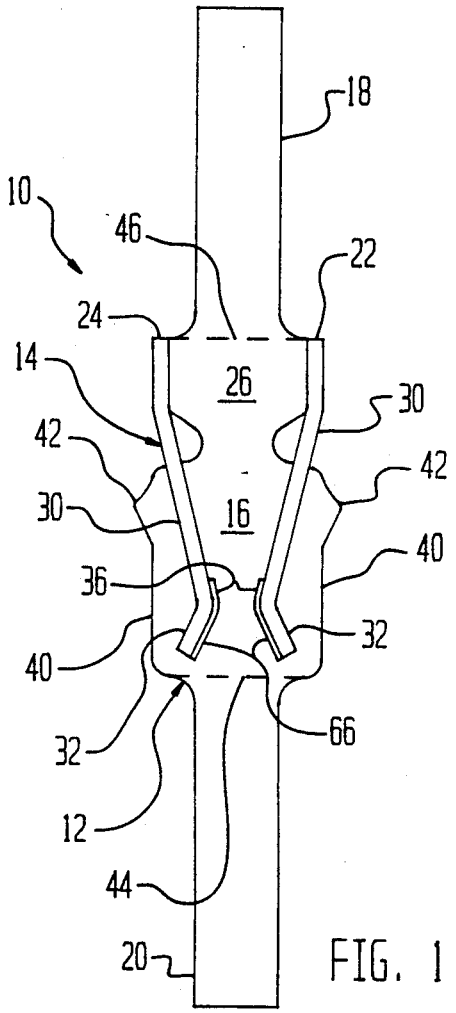
FIG. 1 is a front view of a miniature disconnect terminal according to the invention.

Miniature disconnect terminal 10 includes an integral body 12 stamp-formed from thin metal strip stock such as beryllium copper or other suitable metal. In the disclosed embodiment, the strip stock has a uniform thickness of about 0.004 inch. The body includes a pin contact portion 14, a housing mounting plate 16 and a pair of elongate flat terminal tails 18 and 20 extending longitudinally away from the contact portion and mounting plate, respectively. Contact portion 14 includes a pair of like hook shaped spring members 22 and 24, and a bridge 26 joining the spring arms.

Figure 2:
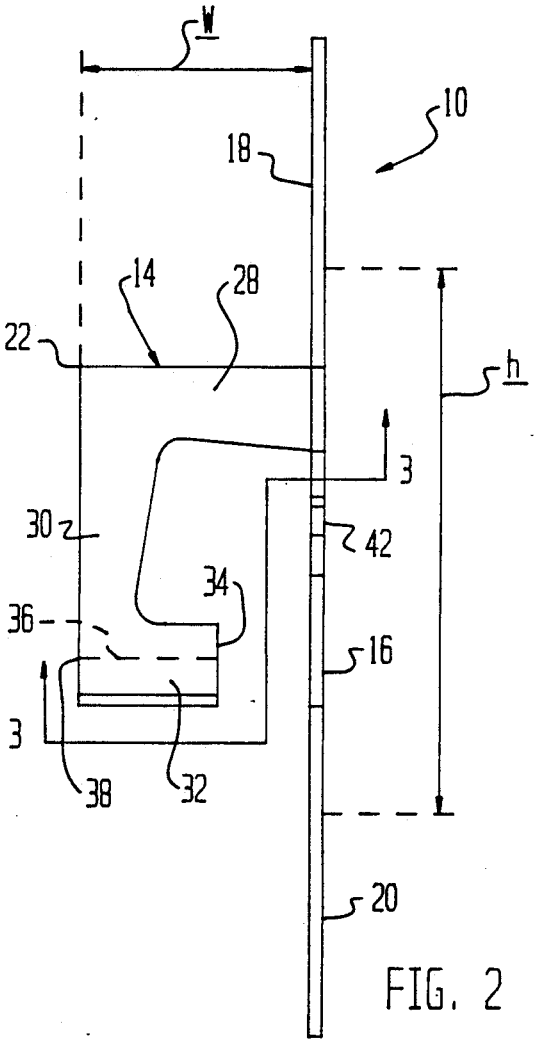
FIG. 2 is a side view of the terminal of FIG. 1.
Figure 4:
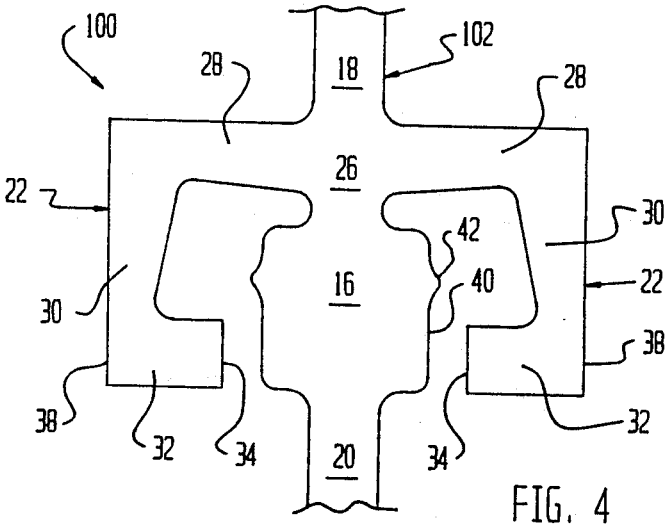
FIG. 4 is a view of a preform used in the manufacture of the terminal.

The terminal is formed from a flat stamped preform 100 shown in FIG. 4. In the terminal mounting the plate 16, bridge 26 and the terminal tails 18 and 20 lie in a common plane and the hook shaped spring member 22 extend generally perpendicularly away from one side of the plane as shown in FIGS. 1 and 2. Each spring member 22, 24 includes a first cantilever and torsion spring arm 28 extending perpendicularly away from the bridge 26, a second cantilever and torsion spring arm 30 joined to the outer end of arm 28 and extending perpendicularly therefrom in a direction generally parallel to the longitudinal axis of the terminal above plate 16, and a rigid contact arm 32 joining the outer end of arm 30 and extending perpendicularly therefrom in a direction back toward the plate 16. The arms 28, 30 and 32 extend in series from the bridge to the outer free end of arms 32.

As shown in FIG. 2, each member 22 is generally hook shaped with arms 28 and 32 generally paralleling each other and joined together by arm 30 which extends generally perpendicularly between arms 28 and 32. Arms 28 and 30 have the same length.

The arms 30 are bent inwardly with respect to arms 28 so that the contact arms 32 are spaced more closely together than parallel arms 28. The spring members have a total length equal to the length of the free arms 28, 30 and 32 and extending from the bridge 26 to the free end 34 of arm 32. The length of the arms is considerably greater than the height of the terminal 10 as measured between score lines 44 and 46. Arms 26 and 30 are uniformly tapered along the length of the spring member with arm 26 having a maximum width adjacent the bridge and a minimum width adjacent its outer end and arm 30 having a maximum width adjacent arm 26 and a minimum width adjacent arm 32.

The spring members are highly compliant and compensate for the inevitable dimensional uncertainty concerning due to the production tolerances inherent in stamp-forming of very small parts. Dimensional variations in very small stamp-formed terminals are, as a percentage of a given dimension of the terminal, considerably greater than dimensional variations encountered in larger terminals, for instance, terminals conventionally used to form electrical connections with pins mounted with a center-to-center spacing of 0.1 inch.

Arms 32 are shorter than arms 28 so that the free ends 34 of arms 32 are spaced a distance above the plate 16 to permit free flexing of the spring members upon insertion of a contact pin between arms 32. The arms 32 are bent along their longitudinal axis to form inwardly facing opposed pin contact ridges 36. The bends in arms 32 strengthen the arms to prevent deformation of the arms during insertion of a pin into the terminal and provide beam and torsional stressing of arms 28 and 30.

Figure 3:
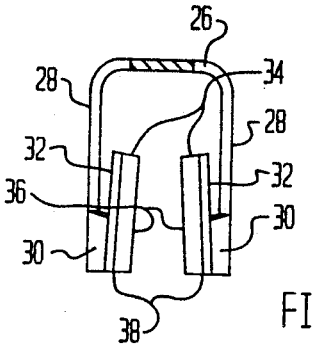
FIG. 3 is a partial sectional view taken along line 3—3 of FIG. 2.
Figure 3A:
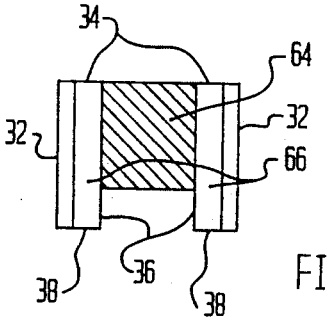
FIG. 3*a* is a partial sectional view illustrating the terminal following insertion of a pin into the terminal.

As illustrated in FIG. 3, arms 30 are slightly twisted during forming so that the straight contact arms 32 converge toward each other away from the outer ends of arms 30. The convergence of arms 32 normally positions free ends 34 more closely together than ends 38 joining ends of arms 30. The contact arms 32 may each extend inwardly toward the other at a small angle of about 2.7 degrees to a line extending perpendicular to the bridge 26. See FIG. 3.

The outer edges 40 of plate 16 are fitted in grooves formed in cavities in an insulated plastic housing. Projections 42 on the edges bite into the plastic in the groove to retain the terminal in place within the housing.

During manufacture of the terminal, a score line 44 or 46 is provided at the inner end of either tail 18 or 20 to facilitate breaking away of one of the tails from the terminal, depending upon the contact requirements of the particular housing receiving the terminal. Terminal 10 preferably is plated with a conductive coating which may include relatively thick gold layer at the contact ridges 36.

Figure 5:
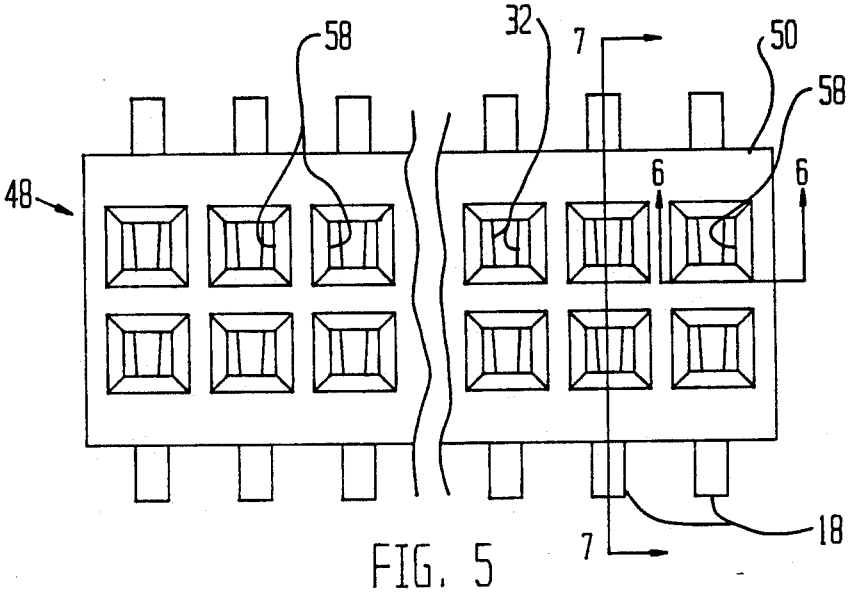
FIG. 5 is a top view of a two-row connector block using terminals according to the invention, partially broken away.
Figure 6:
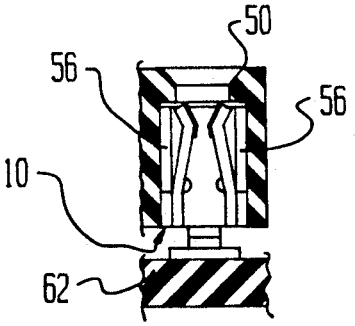
FIGS. 6 and 7 are sectional view taken, respectively, along lines 6—6 and 7—7 of FIG. 5.
Figure 7:
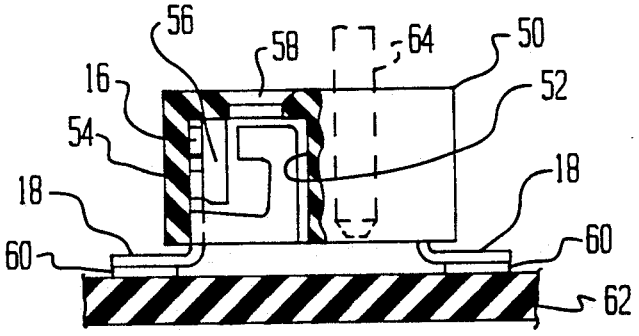

FIGS. 5, 6 and 7 illustrate a top-entry terminal connector block 48 having an elongate molded plastic housing 50 with a pair of rows of terminal cavities 52 spaced along the length of the housing and a terminal 10, with tail 20 removed, fitted in each cavity.

As shown in FIG. 7, the mounting plate 16 and bridge 26 of each terminal rests flush against one end wall of the cavity 52 with the edges 40 fitted in slots on either side of the cavity formed by the adjacent cavity end wall 54 and ridges 56 formed in the cavity sidewalls adjacent the end wall and located a short distance from the end wall 54. The projections 42 bite into the sides of the cavities to hold the terminals 10 within the cavities as illustrated. Chamfered pin insertion openings 58 are formed in the tip of the housing above the ends 34 of contact arms 32 away from arms 30.

With terminals 10 inserted in cavities 52 as described, the terminal mounting plate 16 and bridge 26 are held flush against wall 54 and both spring members 22 extend freely into the cavity. The members are free to flex and do not engage the surfaces of the cavity during insertion or retention of a contact pin into the cavity through opening 58.

As illustrated in FIG. 7, the terminal tails 18 are bent 90 degrees from the positions of FIGS. 1 and 2, trimmed, and are appropriately bonded to contact pads 60 on support member 62. The support member 62 may be a flex circuit, printed circuit board, ceramic substrate or other member. The tails may be bonded to pads 60 typically by reflow solder bonding.

The terminals 10 in connector block 48 form electrical connections with two rows of square contact pins extending outwardly from a pin header of conventional design (not illustrated). The chamfered ends of individual pins 64 are inserted through pin openings 58 and into the cavities above the ends of rigid contact arms 32. Further movement of the pins into the cavities move the ends into engagement with the beveled surfaces 66 on the sides of the arms 32 facing openings 58 to spread the arms apart and, at the same time, rotate of the arms 32 with respect to second spring arms 30. In this way, the insertion of the pin between the rigid contact arms 32 spreads apart and rotates both second spring arms 30 so that these arms are stressed as both cantilever beams and torsion springs. The arms 30 are rotated in response to rotation of the rigid arms 32 extending perpendicular to the length of arms 30.

The cantilever and torsional stressing of arms 30 move first spring arms 28 apart as cantilevers and also rotate and torsionally stress these spring arms. This loading of the arms 28 results from the spreading and rotation arms 30, which extend perpendicularly to the length or longitudinal axis of the arms 28.

The tapered width of arms 28 and 30 promote a more uniform distribution of stress along the length of the arms, thereby increasing deflection range of the arms. Stressing of the terminal 10 during insertion of a pin 64 between ridges 36 occurs without engagement between the spring members 2 and the sides of the cavity 52, and in that way, provides contact with the pin in a very compact and compliant terminal. As a result, reliable electrical connections are formed between the terminals and closely spaced pins 64.

In one embodiment for 1 mm center connectors, terminals 10 may be formed from strip stock having a thickness of approximately 0.004 inch and have a height H of about 0.05 inch. The width of plate 16 is 0.026 inches and the width W at the members 22 of 0.04 inch.

Two row housing 50 has a width of about 0.11 inch and a height of about 0.06 inch. The terminals 10 are located in cavities in the blocks for mating with square pins measuring 0.014 inch across a side molded in a pin header on a rectangular grid spaced apart about 0.04 inch. This very close spacing with the terminals and pins permits forming of very high density reliable electrical connections.

Figure 8:
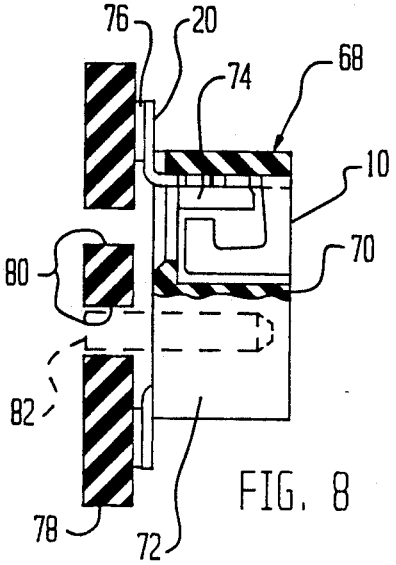
FIG. 8 is a view similar to FIG. 7 illustrating another connector block.

FIG. 8 is a sectional view similar to FIG. 7 illustrating a connector block 68 similar to block 48 in which terminals 10 are mounted in terminal cavities 70 of housing 72. The cavities 70 include ridges 74, likes ridges 56, for holding the mounting plates in position with members 22 extending freely into the cavities. Terminals tails 20 extend outwardly through enlarged pin openings on the bottom of the housing 72 and are bent outwardly 90 degrees. The ends of the tails are bonded to circuit pads 76 on member 78. Two rows of pin holes 80 are formed through the substrate so that contact pins 82 may be extended through the holes, the terminal openings and into the cavities 70 for engaging the terminals 10 in the same way as described in connection with connector block 48.

Figure 9:
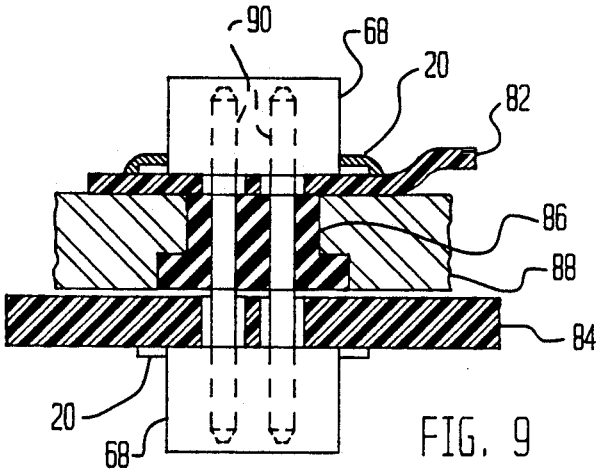
FIGS. 9 and 10 are sectional views illustrating uses of connector blocks using the disconnect terminal.

FIG. 9 illustrates an application in which two connector blocks 68 as shown in FIG. 8 are used in forming electrical connections between contact lines on a flex circuit 82 and contact pads on member 84 using a pin header 86 located in a metal wall 88.

The tails extending outwardly from blocks 68 are suitably bonded to contact leads of flex circuit 82 and pads on member 84 using conventional technology. Clearance holes for pins are formed through the thickness of the flex circuit in alignment with the pin openings on the bottom of upper block 68. Pin holes are also formed through the member 84.

The pin header 86 is bonded into a stepped aperture formed in wall 88 with the ends of pins 90 extending to either side of the header for engagement with the terminals in blocks 68 as illustrated.

The connection system shown in FIG. 9 may be used to form electrical connections between a flex circuit within an encapsulated miniature hard disk drive and a printed circuit board located outside. The pin header 86 is bonded in the wall 88 surrounding the clean head disk assembly.

The height of block 68 located on the inside of wall 88 is approximately equal to the height of the integrated circuit chips mounted on the board 84 so that the electrical interconnection system does not require vertical space outwardly from the board in addition to that required by chips and other members mounted on the board.

Figure 10:
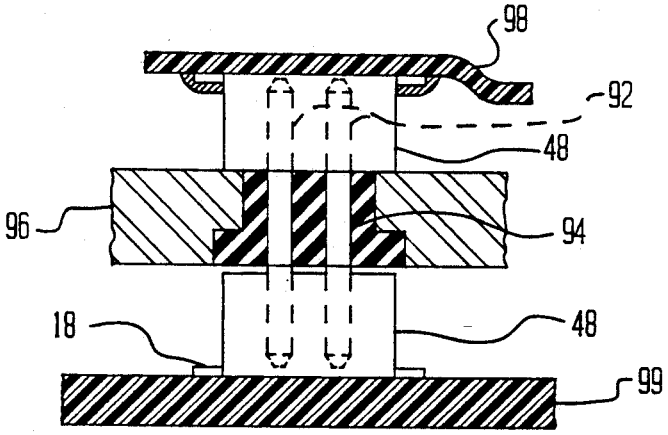

FIG. 10 illustrates another connection system similar to the system shown in FIG. 9 in which pins 92 extending from header 94 in wall 96 engage connector blocks 48. In this system, the terminal tails 18 are bonded to contact pads on a flex circuit 98 and member 99 located outwardly of the blocks 48. This type of connection system may also be used for extending electrical signals through the wall surrounding a small diameter hard disk drive.

The space available for an electrical connection system in a very small hard disk drive is extremely limited. Very small miniature disconnect terminals 10 are advantageously used in forming connections through the walls of miniature hard disk drives because of limited space in the hard disk available for through wall electrical connections and because the height of the blocks engaging the terminal pins is approximately equal to the height of circuit chips which are mounted on the circuit members located inside or outside of metal wall 88. The height of the connector block when mounted on the substrate is not greater than that of a chip thereby permitting mounting of the substrate as close as possible to the adjacent wall so that the substrate occupies a minimum space within the drive.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A miniature disconnect terminal comprising a body stamp-formed from thin sheet metal stock, the body including, A) a pin contact portion including, i) a bridge, ii) a pair of like hook-shaped spring members joining opposite edges of the bridge and extending to one side of the bridge, each spring member having a) a first elongate spring arm joining the bridge and extending transversely away from the bridge at about 90° to a first end, b) a second elongate spring arm joining the end of the first spring arm and extending transversely away from the first arm at about 90° to a second end, and c) an elongate contact arm joining the second end of the second spring arm and extending transversely away from the second arm at about 90° in a direction toward a mounting plate to a free end, iii) opposed pin contact surfaces on the contact arms adjacent the free ends;

B) a mounting plate joined to the bridge and located to one side of the contact arm free ends; and C) contact means joining the bridge or the mounting plate for forming an electrical connection with a circuit element.

2. A terminal as in claim 1 wherein the contact arms include strengthening means for preventing deformation of the contact arms during insertion of a pin into the terminal and the free ends of said contact arms are located closer together than the ends of said second spring arms.

3. A miniature disconnect terminal comprising a body stamp-formed from thin sheet metal stock, the body including, A) a pin contact portion including, i) a bridge, ii) a pair of like spring members joining opposite edges of the bridge and extending to one side of the bridge, each spring member having a) a first elongate spring arm joining the bridge and extending away from the bridge to a first end, b) a second elongate spring arm joining the end of the first spring arm and extending transversely away from the first arm to a second end, and c) an elongate contact arm joining the second end of the second spring arm and extending transversely away from the second arm in a direction generally parallel to the first arm to a free end, said contact arm being shorter than the first arm;

iii) opposed pin contact surfaces on the contact arms adjacent the free ends; and B) contact means joining the bridge for forming an electrical connection with a circuit element.

4. A miniature disconnect terminal comprising a body stamp-formed from thin sheet metal stock, the body including, A) a pin contact portion including, i) a bridge, ii) a pair of like spring members joining opposite edges of the bridge and extending to one side of the bridge, each spring member having a) a first elongate spring arm joining the bridge and extending away from the bridge to a first end, b) a second elongate spring arm joining the end of the first spring arm and extending transversely away from the first arm to a second end, said first and second spring arms being tapered in width, and c) an elongate contact arm joining the second end of the second spring arm and extending transversely away from the second arm in a direction generally parallel to the first arm to a free end, iii) opposed pin contact surfaces on the contact arms adjacent the free ends; and B) contact means joining the bridge for forming an electrical connection with a circuit element.

5. A terminal as in claim 4 wherein the thickness of the body is approximately 0.004 inch.

6. A terminal as in claim 4 wherein the first spring arms generally parallel each other and the ends of the second spring arms are spaced closer together than the ends of the first spring arms.

7. A terminal as in claim 6 wherein the free ends of the contact arms are spaced closer together than the ends of the second spring arms.

8. A terminal as in claim 7 including a ridge extending along the length of each contact arm, said ridges defining said pin contact surfaces.

9. A terminal as in claim 7 wherein said second spring arms are twisted along their longitudinal axis.

10. A terminal as in claim 9 wherein each second spring arm is twisted inwardly by an angle of about 2.7 degrees.

11. A miniature disconnect terminal comprising a body stamp-formed from thin sheet metal stock, the body including, A) a pin contact portion including, i) a bridge, ii) a pair of like spring members joining opposite edges of the bridge and extending to one side of the bridge, each spring member having a) a first elongate spring arm joining the bridge and extending away from the bridge to a first end, b) a second elongate spring arm joining the end of the first spring arm and extending transversely away from the first arm to a second end, and c) an elongate contact arm joining the second end of the second spring arm and extending transversely away from the second arm in a direction generally parallel to the first arm to a free end, iii) opposed pin contact surfaces on the contact arms adjacent the free ends; and B) contact means joining the bridge for forming an electrical connection with a circuit element; and C) a mounting plate joining the bridge between the spring members.

12. A terminal as in claim 11 wherein said plate includes side edges and projections on said edges.

13. A terminal as in claim 11 wherein said contact means comprises a first terminal tail located between said first spring arms.

14. A terminal as in claim 13 including a second terminal tail joining said plate and extending away from said first terminal tail.

15. A terminal as in claim 11 wherein portions of said plate extend outwardly beyond said bridge.

16. A terminal as in claim 15 wherein said plate includes generally parallel edges, said portions of said plate extending outwardly of said edges.

17. A terminal as in claim 16 wherein said contact means comprises a first terminal tail joining said bridge and extending away therefrom in a first direction, said mounting plate joins a bridge on the side thereof away said first terminal tail and including a second terminal tail joining said mounting plate on the side thereof away from the bridge and extending away from the mounting plate in the second direction opposite to said first direction.

18. A miniature disconnect terminal comprising a body stamp-formed from thin sheet metal stock, the body including, A) a pin contact portion including, i) a bridge, ii) a pair of like spring members joining opposite edges of the bridge and extending to one side of the bridge, each spring member having a) a first elongate spring arm joining the bridge and extending away from the bridge to a first end, b) a second elongate spring arm joining the end of the first spring arm and extending transversely away from the first arm to a second end, and c) an elongate contact arm joining the second end of the second spring arm and extending transversely away from the second arm in a direction generally parallel to the first arm to a free end, the contact arm including a beveled surface located outwardly of a pin contact surface, iii) opposed pin contact surfaces on the contact arms adjacent the free ends; and B) contact means joining the bridge for forming an electrical connection with a circuit element.

19. A miniature pin disconnect terminal comprising a body stamp-formed from thin sheet metal stock, the body including, A) a pin contact portion including i) a bridge;

ii) a pair of contact members joined to the bridge at spaced locations, iii) one contact member including a hook-shaped spring member having a pair of discrete elongate and serially arranged spring arms, each spring arm being tapered along the length of the arm with the width of the arm at the arm end adjacent the bridge being greater than the width of the arm at the arm end remote from the bridge, a contact arm joining the end of one of the spring arms and defining a free end of the one contact member, and a first pin contact surface on the contact arm located adjacent the free end, and iv) the other contact member including a second pin contact surface located adjacent to and facing the first pin contact surface; and B) contact means joining the bridge for forming an electrical connection with a circuit element.

20. A terminal as in claim 19 wherein said other contact member is like said one contact member.

21. A terminal as in claim 19 wherein each contact member includes a first spring arm extending away from the bridge and a second spring arm extending transversely to the first spring arm, said contact arm joining the remote end of the second spring arm.

22. A terminal as in claim 21 wherein each said second spring arm is normally twisted about its length through an angle sufficient to move the free ends of the contact arms closer together than the remote ends of the second spring arms.

23. A terminal as in claim 21 wherein said contact arm comprises a folded portion of metal stock, said fold defining the pin contact surface.

24. A terminal as in claim 23 including beveled lead-in surfaces on said contact arms, such lead-in surfaces being spaced further apart than said pin contact surfaces.

25. A terminal connector block including:

A) a housing formed from an insulating material, the housing defining, i) a terminal cavity having interior walls, and ii) a pin opening extending from the outside of the housing to the cavity; and B) a terminal having, i) first means engagable with the housing for mounting a contact portion within the cavity, ii) a contact portion located within said cavity, said portion including a bridge and a pair of like spring members each having, a) an elongate first spring arm joined to the bridge and extending transversely away from the bride to a first end, b) an elongated second spring arm joining the first end of the first spring arm and extending transversely away from the first spring arm to a second end, c) an elongated contact arm joining the second end of the second spring arm and extending transversely away from the second arm in a direction generally parallel to the first arm to a free end, and d) a pin contact surface on the contact arm, such surface being located adjacent the pin opening for physical contact with a pin inserted through the opening and into the cavity so as to stress spring arms, e) said spring members being spaced inwardly from the walls of the cavity to permit free elastic stressing of the spring arms upon engagement with a pin inserted through the pin opening with the contact surface, and iii) a terminal tail extending outwardly of the cavity.

26. A terminal connector block as in claim 25 wherein the free ends of said contact arms are located closer together than the ends of said second spring arms.

27. A terminal connector block as in claim 25 wherein the contact arms are shorter than the first arms.

28. A terminal connector block as in claim 27 wherein the free ends of the contact arms are located adjacent the first means.

29. A terminal connector block as in claim 25 wherein the first and second spring arms are tapered in width with the ends thereof adjacent the first means being wider than the ends thereof remote from the first means.

30. A terminal connector block as in claim 29 wherein the first spring arms generally parallel each other and the ends of the second spring arms are spaced closer together than the ends of the first spring arms.

31. A terminal connector block as in claim 30 wherein the free ends of the contact arms are spaced closer together than the ends of the second spring arms.

32. A terminal connector block as in claim 31 including a ridge extending along the length of each contact arm, said ridges facing each other and defining said pin contact surfaces.

33. A terminal connector block as in claim 31 wherein said second spring arms are twisted along their longitudinal length.

34. A terminal connector block as in claim 25 wherein said first means comprises a mounting plate, said plate engaging walls of the cavity.

35. A terminal connector block as in claim 34 wherein said plate includes side edges, projections on said side edges, said projections engaging walls of the cavity.

36. A terminal connector block as in claim 34 wherein said housing defines a cavity endwall, and a pair of ridges formed in the cavity walls adjacent the endwall and wherein said mounting plate is positioned between the ridges and the endwall.

37. A terminal connector block as in claim 34 wherein said tail joins said mounting plate.

38. A terminal connector block as in claim 34 wherein said tail joins said bridge.

* * * * *